United States Patent [19]

Hamano et al.

[11] Patent Number: 4,786,770

[45] Date of Patent: Nov. 22, 1988

[54] SWITCHGEAR

[75] Inventors: Suenobu Hamano; Hiroyuki Sasao; Yutaka Murai; Yuichi Wada, all of Amagasaki; Hirosi Hasegawa; Tosimasa Maruyama, both of Marugame, all of Japan

[73] Assignee: Mitsubishi Denki Kabushiki Kaisha, Japan

[21] Appl. No.: 59,041

[22] Filed: Jun. 8, 1987

[30] Foreign Application Priority Data

| | | | |
|---|---|---|---|
| Jun. 6, 1986 | [JP] | Japan | 61-130195 |
| Jun. 6, 1986 | [JP] | Japan | 61-130197 |
| Jun. 6, 1986 | [JP] | Japan | 61-130198 |
| Jun. 6, 1986 | [JP] | Japan | 61-130199 |
| Jun. 6, 1986 | [JP] | Japan | 61-130200 |
| Jun. 6, 1986 | [JP] | Japan | 61-130201 |
| Jun. 6, 1986 | [JP] | Japan | 61-130202 |

[51] Int. Cl.[4] ..... H01H 33/18

[52] U.S. Cl. ..... 200/147 R; 200/147 A; 200/148 B

[58] Field of Search ..... 200/147 R, 147 A

[56] References Cited

U.S. PATENT DOCUMENTS

| | | | |
|---|---|---|---|
| 3,892,461 | 7/1975 | Keto | 200/147 A |
| 4,273,977 | 6/1981 | Kii | 200/147 R |
| 4,500,762 | 2/1985 | Yoshizumi | 200/144 AP |
| 4,652,708 | 3/1987 | Okuno et al. | 200/146 R |
| 4,687,890 | 8/1987 | Yamamoto et al. | 200/148 |
| 4,688,136 | 8/1987 | Yamauchi | 361/120 |

FOREIGN PATENT DOCUMENTS

| | | | |
|---|---|---|---|
| 834018 | 5/1960 | United Kingdom | 200/147 A |

*Primary Examiner*—Robert S. Macon

*Attorney, Agent, or Firm*—Leydig, Voit, & Mayer

[57] ABSTRACT

A switchgear comprises in a housing containing an arc extinguishing gas, a pair of separable contacts defining therebetween an arcing region in which an electric arc is generated when the contacts are separated. A cylindrical wall and an insulating nozzle are provided for defining a gas storage chamber around the stationary contact communicated with the arcing region for storing the arc extinguishing gas increased in pressure by heat from the arc. The insulating nozzle defines an opening through which the movable contact movably extends and through which the pressurized arc extinguishing gas flows. Around the arcing region a magnet is disposed for generating a magnetic field in the opening of the gas storage chamber for rotating and elongating the electric arc generated in the arcing region upon current interruption.

14 Claims, 11 Drawing Sheets

SWITCHGEAR

BACKGROUND OF THE INVENTION

This invention relates to a switchgear for an electric circuit and, more particularly, to a self-extinguishing type switchgear having a magnet for generating alternating magnetic flux against an electric arc for driving the arc upon separation of the contacts.

FIG. 1 is a fragmental vertical sectional view of the separated state of a conventional switchgear disclosed in Japanese Utility Model Laid-Open No. 59-77742, and FIG. 2 is a sectional view taken along line II—II of FIG. 1.

In the figures, the reference numeral (1) designates a first terminal plate, (2) designates a stationary contact which is one of a pair of contacts attached to the first terminal plate (1), (3) designates a movable contact which is the other contact for engaging and separating the stationary contact (2), (4) designates a collector which is in sliding contact with the movable contact (3), (5) designates a second terminal plate attached to the collector (4), (6) designates a stationary outer cylinder secured to the first terminal plate (1) at one end and having an opening at the other end, and (7) designates an insulating nozzle secured to the opening of the stationary outer cylinder (6) and made of an insulating material, the insulating nozzle having a through hole (7a) formed so that the movable contact (3) is inserted and slidable therealong. The reference numeral (8) designates an annular magnet disposed in the insulating nozzle (7), (9) designates a storage chamber defined by the stationary outer cylinder (6) for storing an electrically insulating, arc extinguishing gas, (9*a*) designates a storage chamber opening through which the insulating arc extinguishing gas flows into and from the storage chamber, (10) designates an electric arc which is generated when the movable contact (3) separates from the stationary contact (2), (11) designates a cylinder attached at one end to the outer surface of the stationary outer cylinder (6), (12) designates a piston mounted to the movable contact (3) and in sliding contact with the inner surface of the cylinder (11), and (13) designates a negative pressure chamber defined between the cylinder (12) and the bottom face of the stationary outer cylinder (6) that is formed when the movable contact (3) moves in the direction of an arrow A.

Next, the operation will be described.

With this switchgear in its closed state in which the current flows from the first terminal plate (1) to the stationary contact (2) and from the movable contact (3) to the second terminal plate (5) through the collector (4), when the movable contact (3) is driven in the direction of the arrow A by the operating mechanism (not shown), the movable contact (3) separates from the stationary contact (2) and an electric arc is generated between the two contacts.

On the other hand, the annular magnet (8) provides a driving force proportional to the product of the intensity of the magnetic field generated by the magnet and the magnitude of the arc current against the arc (10). The arc (10) is rotated by this driving force and elongated into the storage chamber (9) by centrifugal force.

When the current phase of the arc generated upon the interruption is in the vicinity of the current peak, the surrounding insulating arc extinguishing gas heated by the arc (10) flows into the storage chamber (9) through the storage chamber opening (9*a*) and is stored therein, increasing the temperature and the pressure of the insulating arc extinguishing gas within the storage chamber (9).

Further, when the current phase is in the vicinity of current zero, the pressure of the arc (10) is low and, conversely, the insulating arc extinguishing gas is blown or puffed from the storage chamber (9) to the arc (10), leading to extinction of the arc.

However, when the arc current effective value is small, the pressure rise within the storage chamber (9) is not sufficient, so that the pressure of the insulating arc extinguishing gas within the storage chamber (9) is small and, accordingly, the arc extinguishing capability is insufficient.

In order to cope with this, according to the conventional device, a negative pressure chamber (12) in which pressure decreases upon the interrupting operation of the movable contact (3) is provided, thereby generating a forced gas flow from the storage chamber (9) to the negative pressure chamber (13) through the arc (10) and the insulating nozzle (7), and a magnetic field is applied to the arc (10) to rotate it, thereby generating a relative flow movement between the insulating arc extinguishing gas and the arc, thus extinguishing the arc (10) upon a small current interruption.

Since the conventional device is constructed as described above, a proper arc driving cannot be achieved in response to the arc current value, the effect of the permanent magnet being insufficient, a problem is posed wherein a negative pressure generating device must be added. Also, since the magnet is made annular, and since the conventional cast magnet such as an alnico magnet is high in electrical conductivity, the magnet is heated and degraded quickly by the eddy current resulting from the current flowing through the switchgear.

However, in the conventional switchgear which is constructed and operates as described above, since the magnet (8) is magnetized in the axial direction, the radial component of the magnetic flux ($\phi$) at the gas storage chamber opening (9*a*) is small and the magnetic force in that direction is weak. Therefore, the arc driving force in the circumferential direction acting on the arc (10) at the gas storage chamber opening (9*a*) is small, so that the heating effect of the insulating arc extinguishing gas within the gas storage chamber opening (9*a*) is small, Therefore, the pressure increase of the insulating arc extinguishing gas within the storage chamber (9) is small, and the blasting of the insulating arc extinguishing gas to the arc (10) is weak, posing a problem that sufficient arc extinguishing effect cannot be obtained.

Also, in the conventional switchgear which is constructed as described above, the gas heating effect by the arc is small upon a small current interruption, so that the gas pressure increase within the gas storage chamber (9) is small. Also, since the first contact composed of a finger contact has a plurality of slits axially extending from its tip, it is difficult for the leg of the arc (10) on the first contact (2) to be moved by the magnetic flux ($\phi$) generated by the magnet (8), posing a problem that the flow of the gas relative to the leg of the arc (10) is weak, providing only insufficient arc extinguishing effect.

SUMMARY OF THE INVENTION

Accordingly, an object of the present invention is to provide a reliable switchgear of a simple structure in which no eddy current flows through the magnet and accordingly the magnet does not become heated, and in which the arc is driven properly in accordance with the arc current value.

Another object of the present invention is to provide a switchgear improved in arc extinguishing capability at a small current interruption.

Still another object of the present invention is to provide a switchgear which provides a stable interrupting capability even during a small current interruption.

A further object of the present invention is to provide a switchgear improved in arc extinguising capability at a small current interruption wihch is free from thermal degradation of the magnet even during large current arc generation.

Another object of the present invention is to provide a switchgear in which the eddy current loss in the magnet is reduced to decrease the heating of the magnet, improving the stability and the operating life of the magnet.

With the above objects in view, the switchgear according to the present invention has a gas storage chamber opening formed in a conical shape divergent toward the storage chamber and a permanent magnet which is an annular shaped magnet or annularly arranged magnets made of an electrically insulating material.

According to another aspect of the present invention, the magnet mounted to the nozzle is an annular magnet magnetized in the radial direction.

The switchgear according to the present invention may have, as a magnet for generating a magnetic flux in the radial direction at the gas storage chamber opening, a combined magnet composed of an outer permanent magnet disposed outside of the gas storage chamber and surrounding the gas storage chamber, an annular or cylindrical inner magnet disposed inside of the gas storage chamber, and a magnetic material for short-circuiting the outer and the inner magnets in their magnetic path.

According to another embodiment of the switchgear of the present invention, a cylindrical arc contact made of a good electrically conductive material is disposed around the first contact.

According to the switchgear of the present invention, a non-magnetic holder is mounted outside or inside of the first contact, and an annular second magnet is mounted to the holder.

According to still another embodiment of the switchgear of the present invenntion, the magnet mounted to the nozzle has a magnetic material secured on at least one of the magnetic poles and the magnetic material is positioned close to the arc in the gas storage chamber.

According to the switchgear of the present invention, the magnet mounted to the nozzle may be circumferentially divided into a plurality of sections and a non-magnetic material is circumferentially interposed between each of the magnet sections.

BRIEF DESCRIPTION OF THE DRAWINGS

The present invention will become more readily apparent from the following detailed description of the preferred embodiments of the present invention taken in conjunction with the accompanying drawings, in which.

DETAILED DESCRIPTION OF THE PREFERRED EMBODIMENTS

The present invention will now be described in conjunction with FIG. 3 in which one embodiment of the invention is illustrated.

Figure 1:
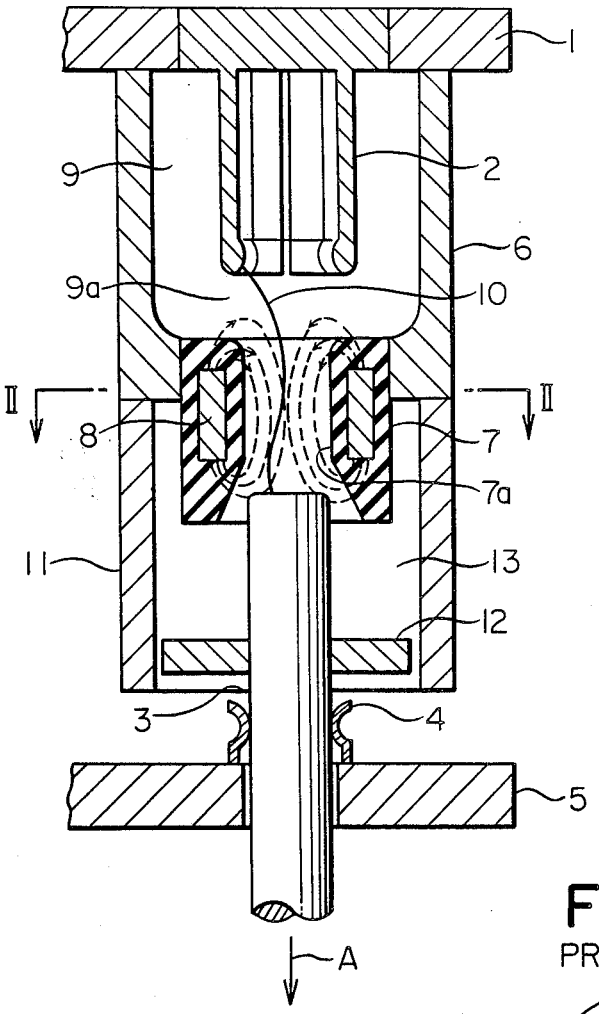
FIG. 1 PRIOR ART
FIG. 1 is a fragmental vertical sectional view of the conventional switchgear.
Figure 2:
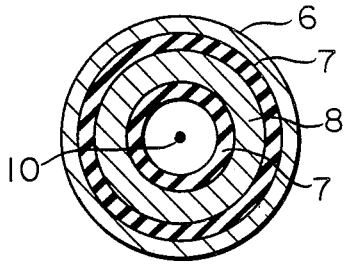
FIG. 2 PRIOR ART
FIG. 2 is a cross-sectional view taken along line II—II of FIG. 1.

In the figure, except for the magnet (21), the insulating nozzle (22) and the gas storage chamber opening (23), the components designated by the reference numerals (1)-(10) are similar to those of the conventional device described in conjunction with FIGS. 1 and 2, so that their descriptions are not repeated here.

The reference numeral (21) designates a permanent magnet disposed outside of the gas storage chamber (9) or the insulating nozzle (22), the permanent magnet being made of an electrically insulating material and having a magnetic flux component in the radial direction in the vicinity of the storage chamber opening (23). Therefore, the arc (10) is generated across the contacts (2) and (3) is driven in the direction of rotation, and the arc (10) is driven outwards in the radial direction by centrifugal force.

Further, since the gas storage chamber opening (23) defined by the lower portion of the stationary outer cylinder (6) and the upper portion of the insulating nozzle (22) is formed in a conical shape divergent toward the storage chamber (9) with an angle equal to or less than 80° relative to its axis. Therefore, even when the current is large, there is no stagnation point as in the conventional design, and when the arc is driven deep into the radial direction, the arc becomes even further removed from the permanent magnet to reduce the driving force and the arc does not intrude unnecessarily deep into the storage chamber (9), so that a localized heating of the gas is prevented, and further upon the blasting of the gas from the storage chamber (9), the flow of the gas can be guided with no drag, resulting in stable arc extinguishing performance for the large current.

Also, when the current value is small, while the driving force is equal to that of the conventional design, since the storage chamber opening (23) is conical, the arc is driven into the interior of the gas storage chamber (9). Therefore, the effect of increasing the gas pressure within the storage chamber (9) is greater than that of the conventional design, providing a stable arc extinguishing performance.

When the permanent magnet is annular, an alternating magnetic field is generated in the permanent magnet by the current flowing through the contacts (2) and (3) when the contacts are closed, and in an electrically conductive magnet such as a conventional electrically conductive Alnico magnet, the magnet is heated by an eddy current and degraded. However, according to the present invention, the magnet (21) is made of an electrically insulating material such as a rare earth metal magnet material, so that no eddy current generates and no heating and no degrading occur. Also, the shape can be made at any desired configuration.

As explained above, the effect of the permanent magnet is sufficient or cases ranging from a small current to a large current and therefore a switchgear of simple structure can be provided in which additional arc extinguishing mechanisms such as a puffer mechanism or a negative pressure puffer mechanism for assisting the self-extinguishing characteristics are not required.

As for the material for the magnet, ferrites, Alnico materials, samarium-rate earth metals and neodymium-iron-boron materials may be used, the arc extinguishing effect is greater with an electrically insulating, magnetically strong magnet.

Figure 3:
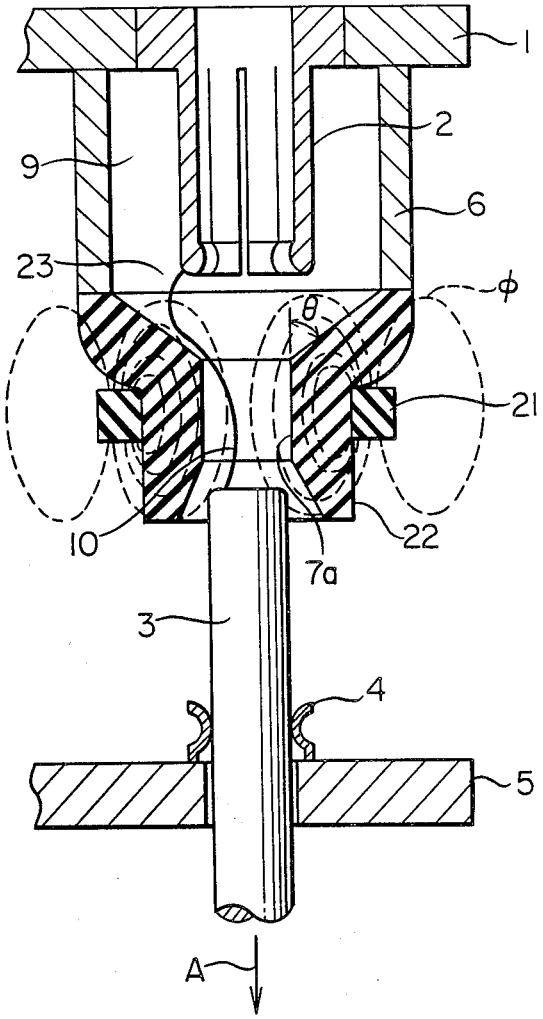
FIG. 3 is a fragmental vertical sectional view of a switchgear of the present invention in the contact open state.

As has been described, according to the embodiment of the present invention shown in FIG. 3, the permanent magnet is a magnet made of an electrically insulating material, and the gas storage chamber opening is configured in a conical shape, so that no eddy current is generated for cases ranging from a small current to a large current and no heating occurs and the driving of the arc can be effectively achieved, so that there is no need for an additional arc extinguishing mechanism, resulting in a simple structure, and therefore providing a reliable switchgear having stable interrupting capability.

Figure 4:
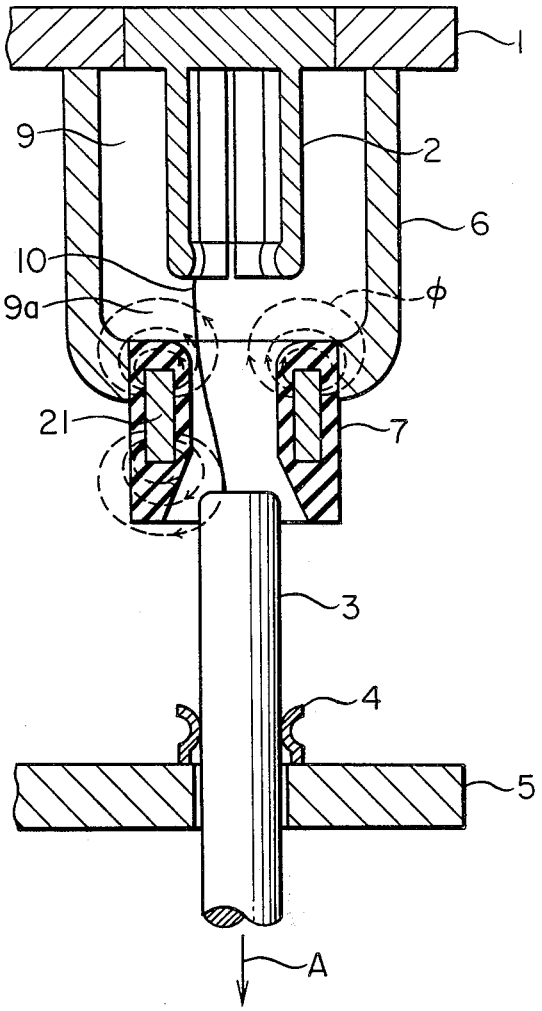
FIG. 4 is a view similar to FIG. 3 but illustrating another embodiment of the present invention.

In FIG. 4, in which another embodiment of the present invention is illustrated, the reference numerals (1)–(10) designate the same or similar components as those in the conventional design except for the magnet (24).

An annular magnet (24) mounted to the nozzle (7) is a magnet magnetized in the radial direction.

Since the magnet (24) of this embodiment is magnetized in the radial direction as described above, the magnetic field at the gas storage chamber opening (9*a*) mainly forms a magnetic flux distributed in the radial direction. Therefore, the magnetic flux that crosses the arc (10) generated between the stationary contact (2) and the movable contact (3) is increased in number and intensity, so that the circumferential driving force acting on the arc (10) is increased and the arc (10) is rotated and elongated in the radial direction, increasing the heating of the insulating arc extinguishing gas by the arc. Therefore, the pressure of the insulating arc extinguishing gas within the gas storage chamber (9) is increased and the blasting of the insulating arc extinguishing gas against the arc (10) is intensified, thereby providing a sufficient arc extinguishing capability.

On the other hand, the radial magnetic field generated by the magnet (24) magnetized in the radial direction exists in the vicinity of the nozzle outlet, and as explained above the arc (10) in the vicinity of the nozzle (7) is rotated to contact with the relative flow of the surrounding low temperature gas, whereby the arc (10) in the vicinity of the nozzle outlet (7) is further cooled to provide a greater arc extinguiging effect.

While the inner side of the magnet (24) is magnetized as an N pole and the outer side is magnetized as an S pole in the above embodiment, the polarity may be reversed, and a plurality of magnets magnetized in the radial direction may be combined into an annular shape, providing effects similar to those in the above embodiment.

Although the magnetic material for the magnet may for example be ferrite metals, Alnico metals, samarium rare earth metals and neodymium-iron-boron magnetic materials, a magnet of a strong magnetic force provides a greater arc extinguishing effect.

As has been described, according to the embodiment of the present invention illustrated in FIG. 4, since the nozzle has mounted thereon an annular magnet magnetized in the radial direction, the radial component of the magnetic flux is greater and, therefore, the arc-rotary driving force is intensified to further expand the arc, thereby increasing the gas pressure within the gas storage chamber even during a small current interruption, resulting in an advantageous switchgear in which the arc extinguishing capability is increased.

Figure 5:
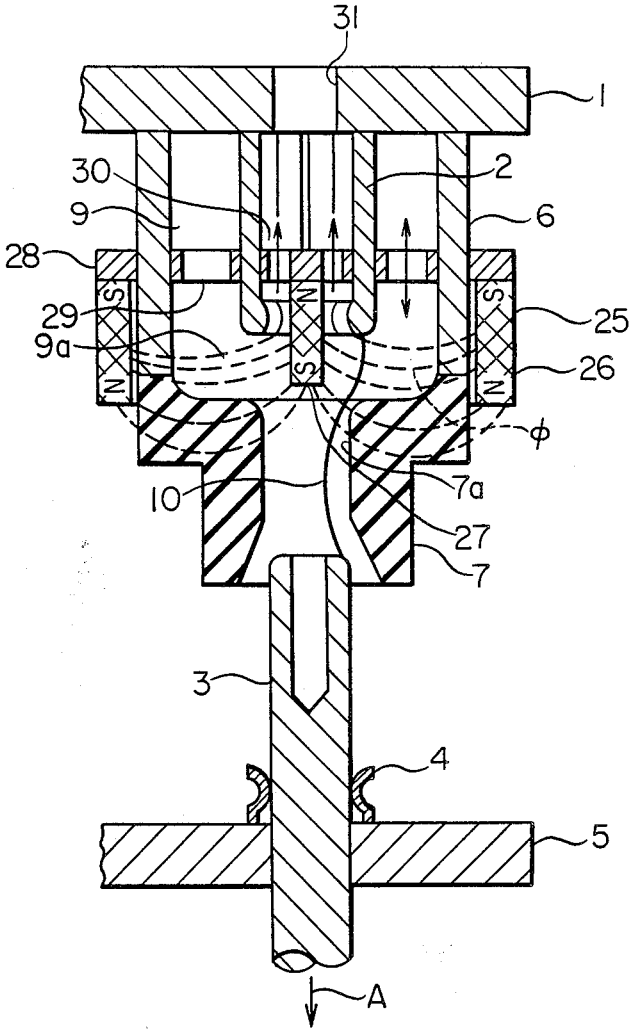
FIG. 5 is a view similar to FIG. 3 but illustrating still another embodiment of the present invention.

In FIG. 5 in which a further embodiment of the present invention is illustrated, the reference numerals (1)–(10) designate the same or similar components as those previously described except for a combined magnet (25). The combined magnet (25) comprises an annular outer permanent magnet (26) magnetized in the axial direction, a rod-shaped inner permanent magnet (27) magnetized in the opposite axial direction, and a magnetic material such as an iron plate (28) short-circuiting the magnetic paths for the magnetic flux generated by the inner and the outer permanent magnets 26 and 27 on the gas storage chamber opening and the opposite side, the magnetic material (28) having formed therein a communication hole (29) for allowing the insulating arc extinguishing gas to flow into the gas storage chamber (9) and a discharge port (30) for discharging a high temperature gas from the arc (10) to the exterior of the arc extinguishing chamber through the stationary contact (2).

In the first terminal plate (1), an exhaust port (31) is provided through which a high temperature gas heated by the arc (10) and discharged from the discharge port (30) is exhausted to the exterior of the arc extinguishing chamber.

When the movable contact (3) is pulled down in the direction of the arrow A by an interruption command with a current flowing through the closed contacts (2) and (3), an electric arc is generated across the contacts (2) and (3), and the insulating arc extinguishing gas heated by the arc (10) is discharged downwardly in the figure through the insulating nozzle (7) and also to the exterior of the arc extinguishing chamber through the exhaust port (31), a part of the arc extinguishing gas entering the gas storage chamber (9) through the gas storage chamber opening (9*a*).

The insulating arc extinguishing gas within the gas storage chamber (9) is heated by the gas entering into the gas storage chamber (9) and the pressure is also increased.

On the other hand, when the arc current reaches close to the zero crossing point, the pressure in the arcing region is decreased and the pressurized insulating arc extinguishing gas within the gas storage chamber (9)

is blasted against the arc (10), thereby cooling the arc to achieve interruption.

The pressure of the insulating arc extinguishing gas stored within the gas storage chamber (9) becomes smaller as the arc current becomes smaller, making the arc extinguishing capability insufficient. The magnetic field in the radial direction in the vicinity of the gas storage chamber opening (9*a*) generated by the combined magnet (25) of the present invention drives the arc (10) into the circumferential direction, and if this drive force is strong enough the arc is expanded into the interior of the gas storage chamber (9) by centrifugal force. Thus, the energy of the arc (10) is effectively stored within the gas storage chamber (9), so that a sufficient pressure rise is obtained even with a small arc current and therefore a stable interrupting capability can be obtained.

In this case, the rotating force for the arc (10) and therefore the centrifugal force therefor is provided only by the radial component of the magnetic field. Therefore, with the magnet arranged to generate a magnetic field in the radial direction mainly in the vicinity of the gas storage chamber opening (9*a*) as in the present invention, the magnetic field can be efficiently utilized in the extinction of the arc (10) even if the absolute magnitude of the magnetic field is small.

Figure 6:
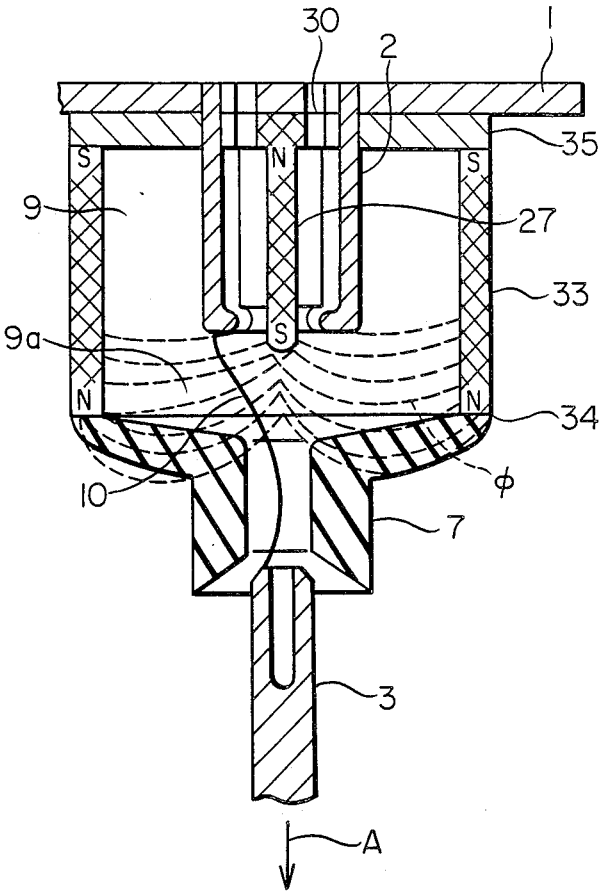
FIG. 6 is a view similar to FIG. 3 but illustrating a further embodiment of the present invention.

In FIG. 6 in which another embodiment of the present invention is illustrated, the reference numeral (33) is a combined magnet as in the previous embodiment, but the annular outer permanent magnet (34) is also used as a stationary outer cylinder defining the gas storage chamber (9), and the iron plate (35) which is a magnetic material is also used as one of the walls of the gas storage chamber (9). In other respects, the construction is similar to the previous embodiment.

With such an arrangement, the number of parts are reduced and the flow of the gas within the gas storage chamber (9) is not impeded, so that a switchgear of a simpler structure exhibiting a stable arc extinguishing capability can be obtained.

Although the magnetic material for the magnet may for example be ferrite metals, Alnico metals, samarium rare earth metals and neodymium-iron-boron magnetic materials, a magnet of a strong magnetic force provides a greater arc extinguishing effect.

As has been described, according to the embodiment of the present invention shown in FIG. 6, the magnet for driving the arc is a combined magnet composed of an outer permanent magnet disposed outside of the gas storage chamber to annularly surround the gas storage chamber, an inner permanent magnet of an annular or a cylindrical shape and disposed inside of the gas storage chamber, and a magnetic material short-circuiting a magnetic path between the magnets. Therefore, the magnetic flux in the radial direction effectively acts on the arc, advantageously providing a switchgear exhibiting a stable small current interrupting capability.

Figure 7:
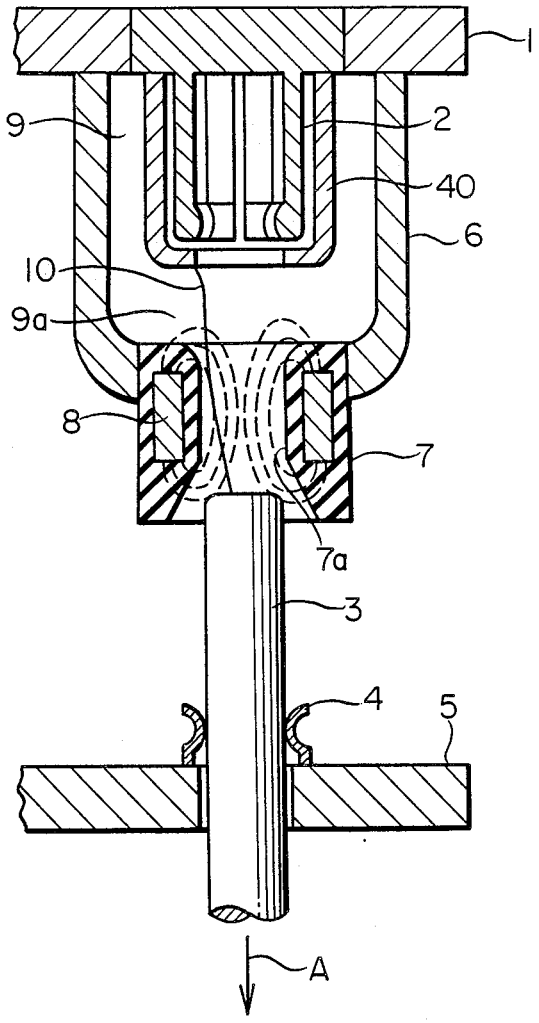
FIG. 7 is a view similar to FIG. 3 but illustrating another embodiment of the present invention.

In FIG. 7 in which a further embodiment of the invention is illustrated, the reference numerals (1)–(10) designate the same or similar components as those in the conventional device.

Also, the reference numeral (40) designates a cylindrical arc contact electrically connected to the stationary side end portion of the stationary contact (2) and disposed outside of the stationary contact (2).

When the movable contact (3) separates from the stationary contact (2), an electric arc (10) generates across the contacts (2) and (3).

When the movable contact (3) further separates, one of the legs of the arc transfers from the stationary contact (2) to the arc contact (40), the arc (10) being generated across the arc contact (40) and the movable contact (3).

On the other hand, the magnet (8) is magnetized in the axial direction, and a radial component of the magnetic flux ($\phi$) is generated at the tip of the arc contact (40). The leg of the arc (10) on the arc contact (40) is subjected to a circumferential direction driving force and rotated by the magnetic flux ($\phi$).

As a result, a relative flow of the insulating arc extinguishing gas is generated relative to the arc (10) on the arc contact (40), whereby the leg of the arc (10) is cooled to sufficiently increase the arc extinguishing capability.

Although the magnetic material for the magnet may for example be ferrite metals, Alnico metals, samarium rare earth metals and neodymium-iron-boron magnetic materials, a magnet of a strong magnetic force provides a greater arc extinguishing effect.

Figure 8:
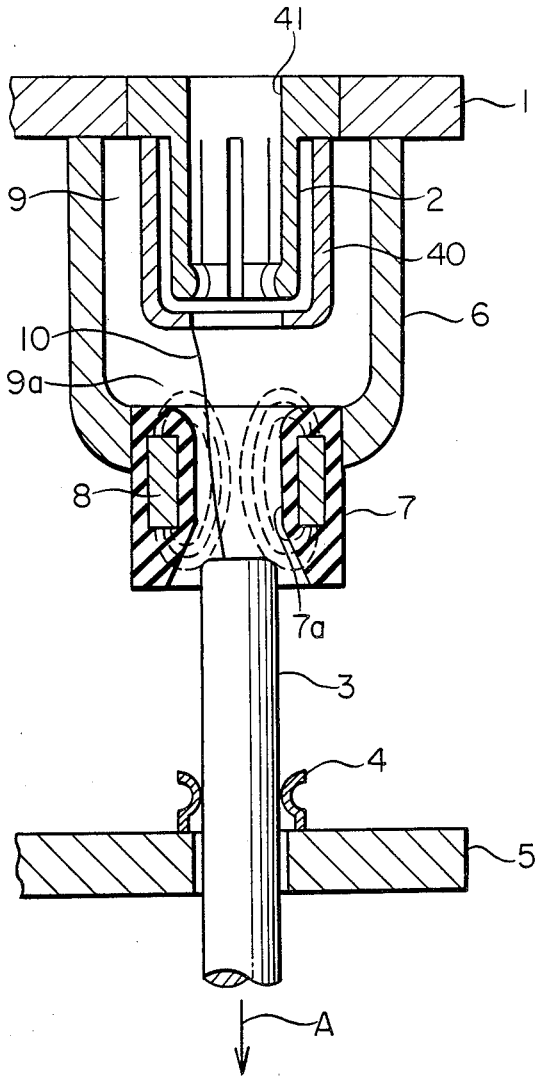
FIG. 8 is a view similar to FIG. 3 but illustrating another embodiment of the present invention.

In FIG. 8 in which still another embodiment of the present invention is illustrated, the reference numerals (1)–(10) designate the components similar to those in the conventional device as previously described, and the reference numeral (40) is the same arc contact as that in the embodiment illustrated in FIG. 7.

The reference numeral (41) is a through hole formed in the stationary side end portion of the stationary contact (2).

The through hole (41) is for rapidly exhausting the high temperature gas generated upon a large current interruption to increase the arc extinguishing capability upon such large current interruption.

The material for the arc contact may be any suitable material such as copper, copper-chromium, aluminium, etc. as long as it is a good electrical conductor, and the tip portion of the arc contact on which the arc generates may preferably be an arc-resistant material such as copper-tungsten, carbon, etc.

As has been described, according to the embodiments shown in FIGS. 7 and 8, since the leg of the arc can be easily moved in the circumferential direction by the magnetic flux generated by the magnet due to the provision of the arc contact which is made of a good electrically conductive material on the outside of the stationary contact, the cooling of the leg of the arc is intensified and, therefore, a switchgear exhibiting a sufficiently high arc extinguishing capability even during a small current interruption is advantageously obtained.

Figure 9:
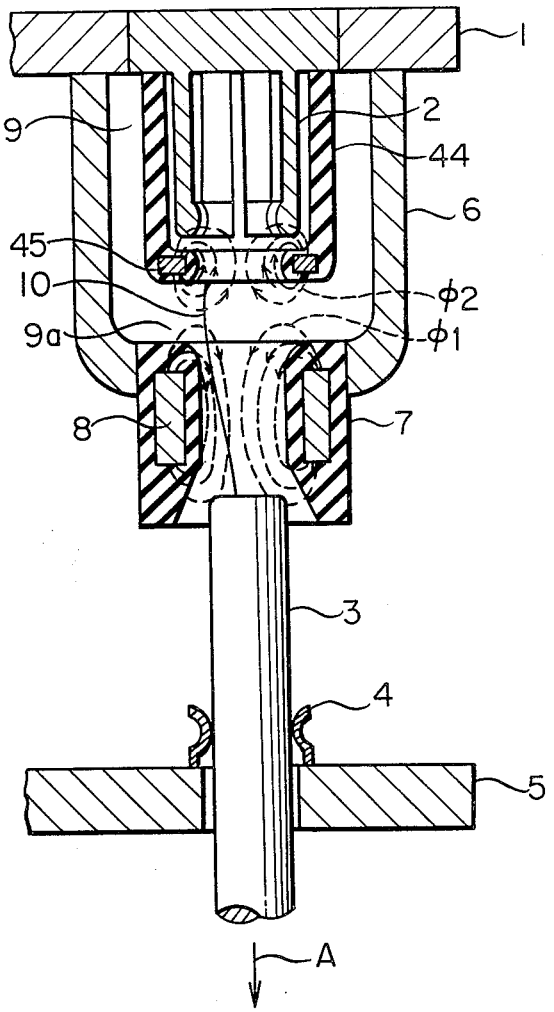
FIG. 9 is a view similar to FIG. 3 but illustrating still another embodiment of the present invention.

In FIG. 9 showing another embodiment of the invention, the reference numerals (1)–(10) designate the same or similar components as those in the conventional device.

The reference numeral (44) designates a rod-shaped or tubular holder of a non-magnetic material disposed outside of the stationary contact (2) and mounted at its one end to the first terminal plate, (45) designates a second magnet mounted on the tip portion of the holder (44), ($\phi$1) designates a first magnetic field generated by the first magnet (8), and ($\phi$2) designates a second magnetic flux generated by the second magnet (45).

Since this embodiment is constructed as described above, the first magnetic flux ($\phi$1) generated by the annular first magnet (8) magnetized in the axial direction and mounted on the nozzle (7) and the second magnetic flux ($\phi$2) generated by the annular second magnet (45) magnetized in the axial direction and mounted on the holder (44) act to strengthen the magnetic flux in the radial direction at the gas storage chamber opening (9a).

When the arc (10) generates across the stationary contact (2) and the movable contact (3), the arc (10) crosses the above magnetic flux ($\phi 1+\phi 2$) which is intensified by the two components thereof. Therefore, the arc is subjected to a large driving force in the circumferential direction by the intensified magnetic flux ($\phi 1+\phi 2$) to be elongated in the radial direction, so that the gas pressure within the gas storage chamber (9) is increased by the heating effect of the arc or the insulating arc extinguishing gas, and the blasting effect of the thereby pressure-increased insulating arc extinguishing gas against the arc is increased to improve the arc extinguishing capability. Further, a similar advantageous effect can be obtained by magnetizing the first and the second magnets 8 and 45 in the radial direction.

Although the magnetic material for the magnet may for example be ferrite metals, Alnico metals, samarium rare earth metals and neodymium-iron-boron magnetic materials, a magnet of a strong magnetic force provides a greater arc extinguishing effect.

Figure 10:
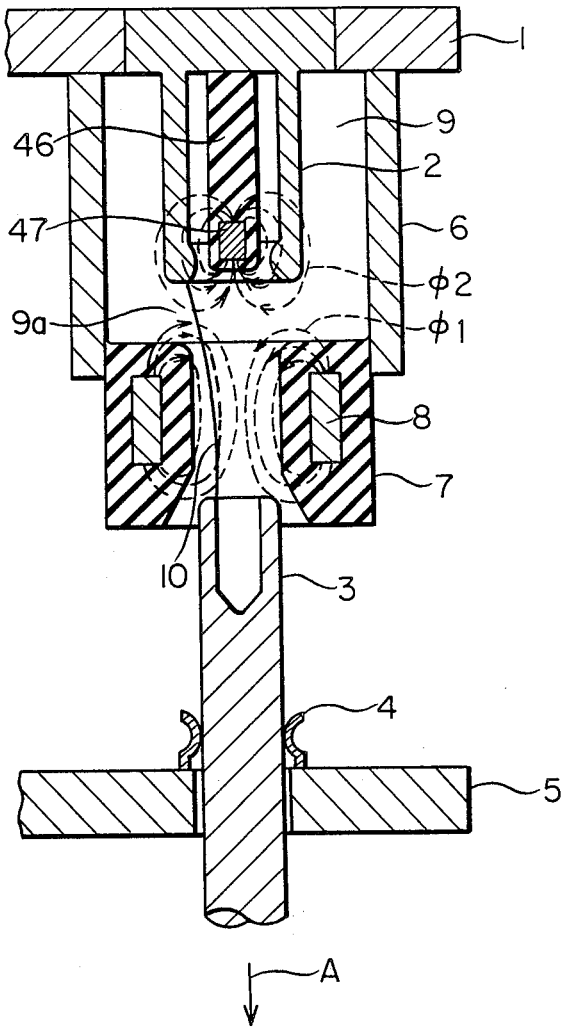
FIG. 10 is a view similar to FIG. 3 but illustrating a further embodiment of the present invention.

In FIG. 10 in which still another embodiment is illustrated, a rod-shaped holder (46) made of a non-magnetic material is disposed inside the stationary contact (2) and the holder (46) is provided with a second magnet (47). An advantageous effect and operation which are similar to those in the above embodiment described in conjunction with FIG. 9 can be obtained.

According to the embodiments shown in FIGS. 9 and 10, the first magnet (8) mounted on the nozzle 7 and the second magnets (45) and (47) are arranged to have the N pole on the gas storage chamber opening (9a) and the S pole on the opposite side. However, the first magnet and the second magnet can be magnetized in the radial direction. Alternatively, the first magnet (8) may be magnetized in the axial direction and the second magnet (45) and (47) may be magnetized in the radial direction, or the magnetization may be combined oppositely.

In summary, the magnets may be arranged in any manner as long as they function so that the radial magnetic flux generated by the first and the second magnets may be intensified at the gas storage chamber opening (9a).

Further, the holder (44) or (46) may be made of an electrically insulating material or a metal as long as it is non-magnetic.

As has been described, according to certain embodiments of the present invention, since a second magnet can be mounted on the tip of the holder in the vicinity of the first contact, the magnetic flux in the radial direction at the gas storage chamber opening generated by the first magnet disposed on the nozzle and the second magnet is intensified. Therefore, the arc driving force is increased to expand the arc and the heating effect of the insulating arc extinguishing gas is increased, resulting in an advantageous effect that arc extinguishing capability of the switchgear is increased even upon the interruption of a small current.

Figure 11:
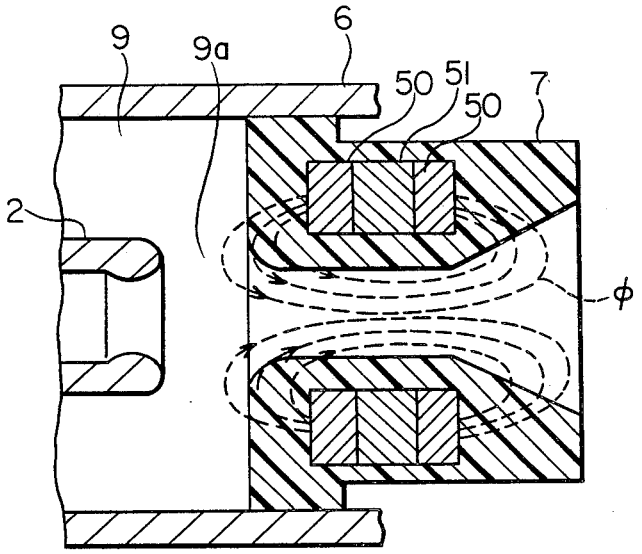
FIG. 11 is a fragmental sectional view illustrating still another embodiment of the present invention.

In FIG. 11, the stationary contact (2), the outer cylinder (6), the nozzle (7), the magnet (8), the gas storage chamber (9) and the gas storage chamber opening (9a) are similar to those previously described.

The reference numeral (50) designates an annular magnetic material secured to one of the annular magnets (51) magnetized in the axial direction, the magnetic material being secured to both of the magnetic poles in this embodiment. This magnetic material (50) is disposed close to the gas storage chamber opening (9a) through the nozzle (7), thereby strengthening the magnetic field ($\phi 1$) in the gas storage chamber opening.

In this embodiment, since the switchgear is constructed as described above and the magnetic field ($\phi$) is intensified at the gas storage chamber opening (9a), a sufficient interrupting capability is obtained even during a small current interruption by the interaction of the magnetic field and the arc.

During a large current interruption, the arc energy increases and the tip portion of the magnetic material (50) is heated through the nozzle (7) by the thermal or radiation energy generated by the arc. However, the magnetic material is made of a heat resistant material such as iron, so that the magnet (51) is prevented from being thermally degraded.

Figure 12:
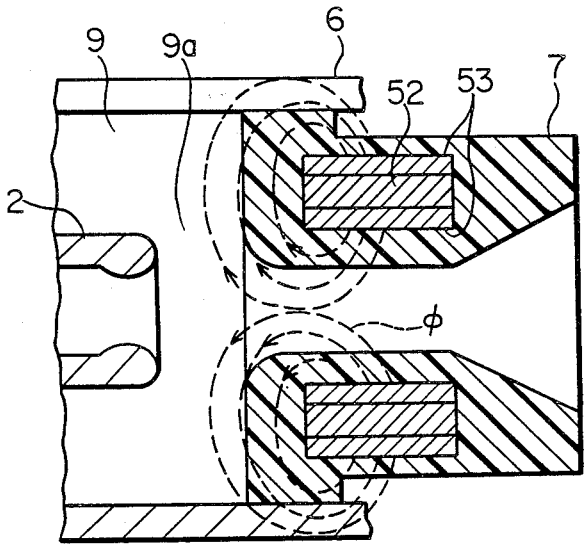
FIG. 12 is a view similar to FIG. 11 but illustrating a further embodiment of the present invention.

FIG. 12 is a fragmental vertical cross-sectional view showing the state of the magnet disposed in a switchgear of another embodiment of the present invention.

In FIG. 12, at least one of the magnetic poles of a magnet 52 of or arranged in an annular shape and magnetized in the radial direction has a magnetic material (53) of or arranged in an annular shape secured thereto, the magnetic material being secured on both of the magnetic poles in this embodiment, and functioning in a similar manner to that described above.

Although the magnetic material for the magnet 51 or 52 may for example be ferrite metals, Alnico metals, samarium rare earth metals and neodymium-iron-boron magnetic materials, a magnet of a strong magnetic force provides a greater arc extinguishing effect.

As has been described, according to the embodiment of the present invention shown in FIGS. 11 and 12, since at least one of the magnetic poles of the magnet disposed in the nozzle is provided with a magnetic material, the magnetic field can be intensified at the chamber opening and the thermal effects of the arc on the magnet can be decreased by the magnetic material, so that a reliable, inexpensive switchgear exhibiting superior small current interruption capability and free from the thermal degradation of the magnet can be advantageously obtained.

Figure 13:
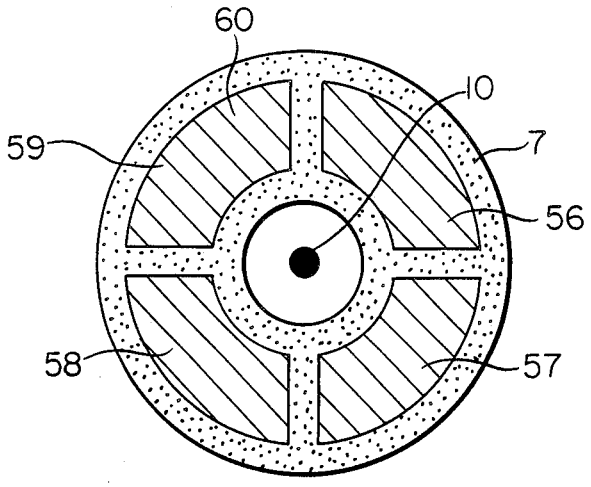
FIG. 13 is a cross sectional view similar to FIG. 2 but illustrating the section of the magnet of another embodiment of the present invention.
Figure 14:
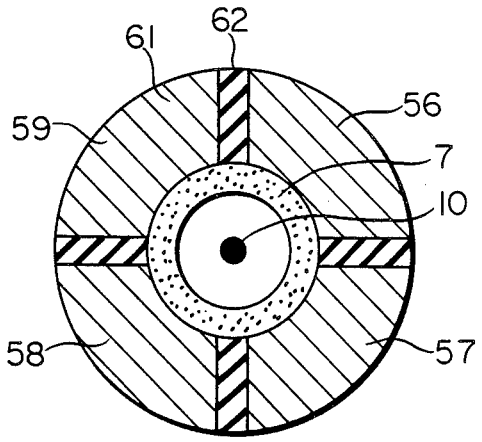
FIG. 14 is a view similar to FIG. 13 but illustrating still another embodiment of the present invention.

FIG. 13 is a cross-sectional view illustrating how the magnet of the switchgear of the first embodiment of the present invention is disposed, and FIG. 14 is a cross-sectional view illustrating how the magnet of the second embodiment of the present invention is disposed, and the reference numeral (7) designates similar components to the nozzle in the conventional device.

In FIGS. 13 and 14, the reference numerals (56), (57), (58) and (59) designate a plurality of segments divided from a magnet (60) or (61) and mounted to the nozzle (7), the number of the segments being four in this embodiment, and (62) designates a spacer made of a non-magnetic material and interposed between each of the magnet segments (56)-(59).

While the circumferential magnetic flux generated by the current of a large current arc or during current carrying concentrates in the magnet which has a small magnetic reluctance and increases the number of the magnetic fluxes since the magnet of the switchgear of the present invention is constructed as described above and since the circumferentially divided magnet segments are disposed in the nozzle made of a non-magnetic material such as tetrafluoroethylene so that the segments are not in contact with each other as shown in FIG. 13 and 14, the magnetic reluctance in the circumferential direction is increased and, therefore, the amount of the magnetic flux generated by the alternating current and passing through the magnet (61) is reduced. Therefore, eddy current loss is reduced and the heating of the magnet is decreased, whereby a stable arc extinguishing capability can be obtained due to the stable magnetic force and the long life of the magnet.

Although the magnetic material for the magnet may for example be ferrite metals, Alnico metals, samarium rare earth metals and neodymium-iron-boron magnetic materials, a magnet of a strong magnetic force provides a greater arc extinguishing effect.

In the embodiment shown in FIG. 13, the circumferentially divided magnet sections (56)-(59) are embedded within the nozzle (7) so that they do not contact with each other. However, a spacer (62) may be fixedly interposed between each of the circumferentially divided magnet segments (56)-(59) as in the embodiment shown in FIG. 14, also providing an advantageous effect similar to that in the embodiment shown in FIG. 13.

The material for the spacer (62) may be a solid body of a metal or a gas such as an air gap as long as it is a non-magnetic material. These material may also be combined.

As has been described, according to the present invention, since the magnet mounted on the nozzle is divided into a plurality of magnet sections and a non-magnetic material is interposed between the divided magnet segments, the magnetic reluctance in the circumferential direction is increased, and the amount of the magnetic flux passing through the magnet is reduced. Therefore, the eddy current loss and the heating of the magnet are reduced, resulting in an advantageous switchgear in which the magnetic force is stable and the life of the magnet is long.

What is claimed is:

1. A switchgear comprising in a housing containing an arc extinguishing gas, a stationary contact;

a movable contact capable of contacting with and separating from said stationary contact, said movable contact and said stationary contact defining therebetween an arcing region in which an electric arc is generated when said contacts are separated;

means for defining a gas storage chamber around said stationary contact communicated with said arcing region for storing the arc extinguishing gas increased in pressure by heat from the arc;

an insulating nozzle attached to said gas storage chamber for defining an opening through which said movable contact movably extends and through which said arc extinguishing gas flows; and magnet means for generating a magnetic field in said opening of said gas storage chamber for rotating and elongating the electric arc generated between said stationary contact and said movable contact upon current interruption;

said insulating nozzle defining a smooth inner transition surface connecting said gas storage chamber to said opening for permitting a smooth flow of the pressurized arc extinguishing gas through said opening, and said magnet means being made of an electrically insulating material.

2. A switchgear as claimed in claim 1, wherein said inner transition surface of said insulating nozzle is a tapered surface convergent from said gas storage chamber to said opening.

3. A switchgear as claimed in claim 1, wherein said magnet means is annular.

4. A switchgear as claimed in claim 1, wherein said magnet means is an annular magnet mounted on said nozzle.

5. A switchgear as claimed in claim 1, wherein said magnet means is annular and magnetized in the radial direction.

6. A switchgear comprising in a housing containing an arc extinguishing gas, a stationary contact, a movable contact capable of contacting with and separating from said stationary contact, said movable contact and said stationary contact defining therebetween an arcing region in which an electric arc is generated when said contacts are separated;

means for defining a gas storage chamber around said stationary contact communicated with said arcing region for storing the arc extinguishing gas increased in pressure by heat from the arc;

an insulating nozzle attached to said gas storage chamber for defining an opening through which said movable contact movably extends and through which said arc extinguishing gas flows; and magnet means for generating a magnetic field in said opening of said gas storage chamber for rotating and elongating the electric arc generated between said stationary contact and said movable contact upon current interruption;

said magnet means being an annular outer magnet disposed around said gas storage chamber, an inner magnet desposed within said gas storage chamber, and a magnetic material connecting said inner magnet to said outer magnet for short-circuiting the magnetic path therebetween.

7. A switchgear as claimed in claim 1, wherein said magnet means comprises an annular outer magnet disposed around said gas storage chamber, an inner magnet desposed within said gas storage chamber, and a magnetic material connecting said inner magnet to said outer manget for short-circuiting the magnetic path therebetween.

8. A switchgear as claimed in claim 7, wherein said outer magnet is mounted to the outer surface of said means for defining said gas storage chamber.

9. A switchgear as claimed in claim 7, wherein said outer magnet forming said means for defining said gas storage chamber.

10. A switchgear as claimed in claim 1, wherein a cylindrical arcing contact is disposed around said stationary contact.

11. A switchgear as claimed in claim 7, wherein said stationary contact is tubular and has a gas exhaust port.

12. A switchgear comprising in a housing containing an arc extinguishing gas, a stationary contact;

a movable contact capable of contacting with and separating from said stationary contact, said movable contact and said stationary contact defining therebetween an arcing region in which an electric arc is generated when said contacts are separated;

means for defining a gas storage chamber around said stationary contact communicated with said arcing region for storing the arc extinguishing gas increased in pressure by heat from the arc;

an insulating nozzle attached to said gas storage chamber for defining an opening through which said movable contact movably extends and through which said arc extinguising gas flows; and magnet means for generating a magnetic field in said opening of said gas storage chamber for rotating and elongating the electric arc generated between said stationary contact and said movable contact upon current interruption;

said magnet means including a first annular magnet mounted to said nozzle and a second annular magnet disposed outside of said stationary contact within said gas storage chamber.

13. A switchgear as claimed in claim 1, wherein said magnet means includes a first annular magnet mounted to said nozzle and a second annular magnet disposed outside of said stationary contact within said gas storage chamber.

14. A switchgear as claimed in claim 13, wherein said magnet means includes a first annular magnet mounted to said nozzle and a second annular magnet disposed inside of said stationary contact within said gas storage chamber.

* * * * *